US009498396B2

(12) United States Patent
Bradford

(10) Patent No.: US 9,498,396 B2
(45) Date of Patent: Nov. 22, 2016

(54) MEDICAL LOCK FOR PRESSURE VESSEL FOR HUMAN OCCUPANCY

(75) Inventor: Jeffrey Bradford, Jurong (SG)

(73) Assignee: Advanced Marine Pte Ltd, Singapore (SG)

( * ) Notice: Subject to any disclaimer, the term of this patent is extended or adjusted under 35 U.S.C. 154(b) by 489 days.

(21) Appl. No.: 14/111,179

(22) PCT Filed: Apr. 14, 2011

(86) PCT No.: PCT/SG2011/000148

§ 371 (c)(1),
(2), (4) Date: Dec. 9, 2013

(87) PCT Pub. No.: WO2012/141654

PCT Pub. Date: Oct. 18, 2012

(65) Prior Publication Data

US 2014/0083015 A1 Mar. 27, 2014

(51) Int. Cl.

| | |
|---|---|
| ***A61G 10/00*** | (2006.01) |
| ***A61G 10/02*** | (2006.01) |
| ***E05F 1/04*** | (2006.01) |
| ***B63C 11/32*** | (2006.01) |
| ***E05D 15/00*** | (2006.01) |
| ***E06B 3/34*** | (2006.01) |

(52) U.S. Cl.

CPC ..... *A61G 10/023* (2013.01); *A61G 10/026* (2013.01); *B63C 11/325* (2013.01); *E05D 15/00* (2013.01); *E05F 1/04* (2013.01); *E06B 3/34* (2013.01)

(58) Field of Classification Search

CPC .... A61G 10/00; A61G 10/005; A61G 10/02; A61G 10/023; A61G 10/026; A61G 10/04; B63C 11/32; B63C 11/325; B63C 11/34; B63C 11/36; B63C 11/38; B63C 11/42; B63C 11/44; A61M 16/06; A61M 16/0627; A61M 16/10–16/1015; A61M 2202/0208; F17C 13/06; F16J 13/16; F16J 13/18; B65D 43/20; B65D 43/16; B65D 43/14; E21F 1/14; E21F 1/145; B01L 1/02

USPC ..... 220/582, 581, 601, 661, 812, 811, 810

See application file for complete search history.

(56) References Cited

U.S. PATENT DOCUMENTS

| | | | | |
|---|---|---|---|---|
| 443,350 | A | 12/1890 | Berners | |
| 6,352,078 | B1 * | 3/2002 | Harvey | B63C 11/32 128/200.24 |
| 7,017,979 | B1 * | 3/2006 | Headlee | B60J 5/0416 296/155 |

FOREIGN PATENT DOCUMENTS

| | | | |
|---|---|---|---|
| FR | 2068949 | A | 9/1971 |
| GB | 1297850 | A | 11/1972 |
| IT | WO0003673 | A2 | 1/2000 |

OTHER PUBLICATIONS

International Search Report of PCT/SG2011/000148 completed by Australian Patent Office on Aug. 8, 2011 and mailed Aug. 12, 2011 (3 pages).

European Committee for Standardization, Jan. 2006, Pressure vessels for human occupancy (PVHO)—Multi-place pressure chamber systems for hyperbaric therapy—Performance, safety requirements and testing, prEN 14831:2006 European Standards, See Chapter 4.2.10.

* cited by examiner

*Primary Examiner* — Tan-Uyen (Jackie) T Ho
*Assistant Examiner* — Ned T Heffner
(74) *Attorney, Agent, or Firm* — Pyprus Pte Ltd

(57) ABSTRACT

The present invention describes a medical, supply or transfer lock (120) for a pressure vessel (100) for human occupancy. The medical lock (120) includes a body tube (122), an outer door flange (124) and an outer door (140) in sealing face relation with an inside face (125) of the outer door flange (124). In an embodiment, the outer door (124) has upper rollers (146*a*) and lower rollers (146*b*). The upper rollers run on a horizontal rail (160) while the lower rollers run on a slant rail (170), which is mounted below the horizontal rail (160). The ends of the horizontal and slant rails (160,170) are curved (163, 172) so that weight component of the outer door is generated to assist the outer door to close. When pressure in the medical lock (120) is increased, the outer door (140) of this medical lock (120) becomes self-locking and self-sealing.

9 Claims, 11 Drawing Sheets

MEDICAL LOCK FOR PRESSURE VESSEL FOR HUMAN OCCUPANCY

FIELD OF INVENTION

The present invention relates to a medical, supply or transfer lock for a pressure vessel, which is used for human occupancy. Such pressure vessels are used for recompression or decompression treatment of divers or miners, saturation diving systems or hyperbaric oxygen treatment of patients.

BACKGROUND

FIG. 1A shows a typical decompression or recompression treatment pressure vessel 10 for human occupancy. FIG. 1B shows an end view of the pressure vessel shown in FIG. 1A. As shown in FIG. 1A, the pressure vessel 10 is divided into two sections, an inner treatment chamber 12 and an outer airlock chamber 13. Each of the treatment chamber and airlock chamber is closed by a swing door 30. In FIGS. 1A and 1B, a known supply or medical lock 20 is shown. The supply/medical lock 20 is typically a round cylindrical pipe that penetrates into the pressure vessel 10 with a door each at the inside and outside end. The outside door 24 is outwardly hinged by means of winged bolts, tension clamps, breach lock, etc. and is externally pressed against a flange around the cylindrical pipe. The disadvantage of this known supply/medical 20 is that it is not self-locking and its air-tightness depends on the integrity of the bolts/clamps in compressing the door seals against the door flange. Further, these door locking parts are heavy and bulky, and they require regular inspection and maintenance. As the pressure inside the pressure vessel 10 and also the medical lock 20 is higher than ambient most of the time, there is always a force tending to open the outside door 24 outwardly. For safety purposes, a safety interlock mechanism has to be provided at the outside door 24.

During decompression or recompression treatment, a patient may be accompanied by a doctor. Such treatment in these enclosed chambers may take many hours. During treatment, the patient may require food, drink or medicine, which must be transferred into these enclosed chambers without affecting the treatment chamber's pressure; such supplies are delivered, for example on a tray, through the supply, medical or transfer lock.

It can thus be seen that there exists a need for a new medical or supply lock that is robust in design and which can overcome the disadvantages of the existing prior art.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

The present invention seeks to provide a new medical lock system for use on a pressure vessel for human occupancy. In one embodiment, the medical lock 120 has a self-locking outer door 140, which is easy to operate and maintain.

In one embodiment, the present invention provides a medical lock for a pressure vessel for human occupancy comprising: a body tube for penetration mounting with a shell of said pressure vessel, with an outer end of said body tube extendable outside said pressure vessel whilst its inner end is disposed inside said pressure vessel; an outer door flange connected to said outer end of said body tube; and an outer door in sealing face relation with an inside face of said outer door flange; wherein pressure inside said medical lock allows said outer door to be self-locking and self-sealing.

In another embodiment, the medical lock further comprises: a substantially horizontal rail mountable on each of two sides of said body tube; and a support axis, which extends out of each of two sides of said outer door; wherein extended ends of said support axis are constrained to move on said substantially horizontal rails when said outer door is being opened or closed.

In another embodiment, the medical lock further comprises: a slant rail mountable below said substantially horizontal rail; and another support axis, which extends out of each of two sides of said outer door in spaced apart relation with said (first) support axis; wherein extended ends of said another support axis are constrained to move on said slant rail when said outer door is being opened or closed.

In another embodiment of the slant rail, an inclined edge of said slant rail, on which said extended ends of said another support axis are constrained to move, leads to a curved slot in a lower surface of said substantially horizontal rail. The curved slot has a heel to prevent said extended ends of said another support axis from being dislodged without applying an uplift force.

In yet another embodiment of the medical lock, each extended end of said support axis or each extended end of said another support axis comprises a roller, a slider or a skate.

BRIEF DESCRIPTION OF THE DRAWINGS

This invention will be described by way of non-limiting embodiments of the present invention, with reference to the accompanying drawings, in which.

DETAILED DESCRIPTION

Figure 1A:
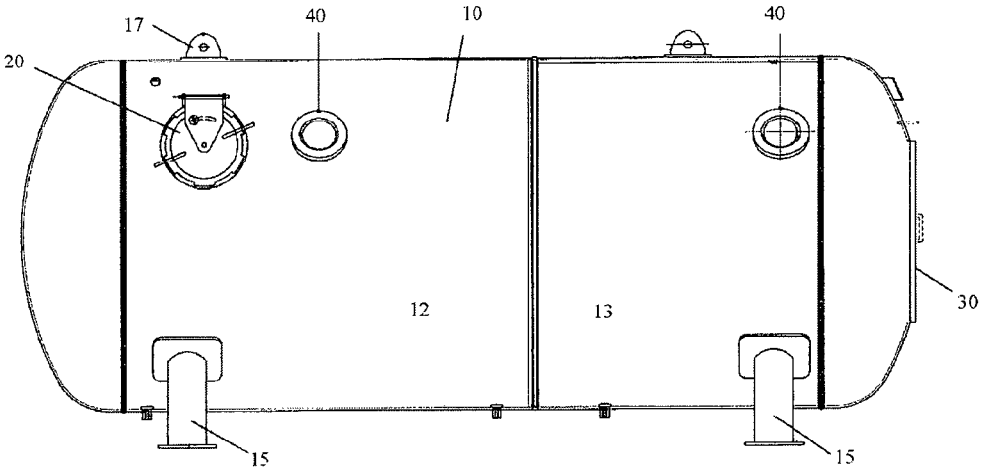
FIG. 1A (PRIOR ART)
FIG. 1A illustrates a known decompression or recompression pressure vessel for human occupancy.
Figure 1B:
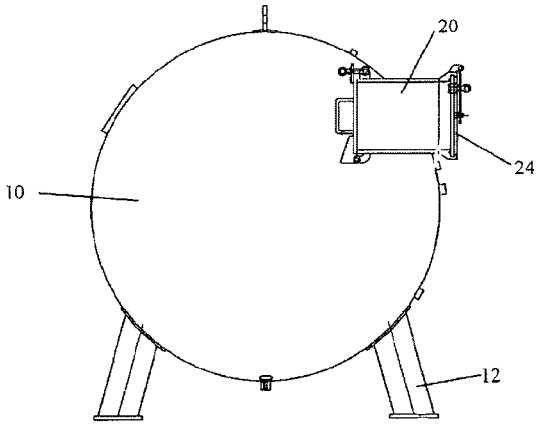
FIG. 1B illustrates an end view of the pressure vessel shown in FIG. 1A.

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures.

Figure 2A:
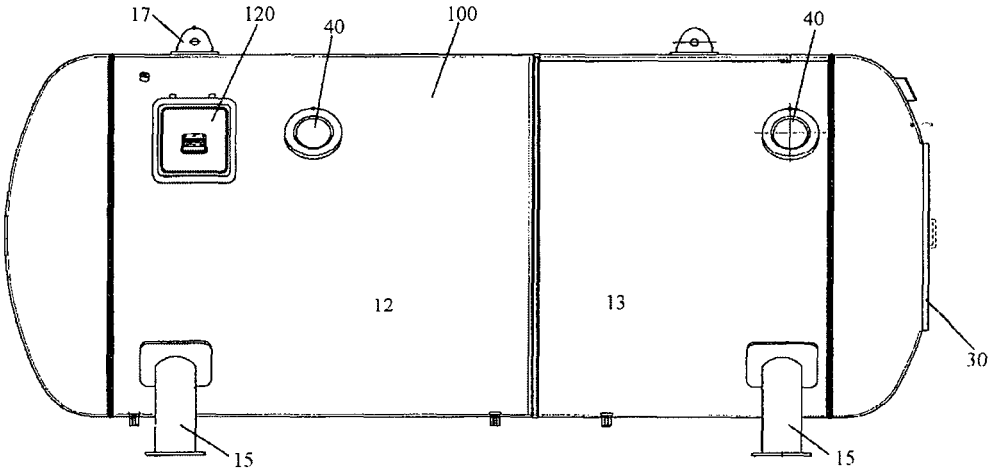
FIG. 2A illustrates a decompression or recompresssion pressure vessel for human occupancy according to an embodiment of the present invention.
Figure 2B:
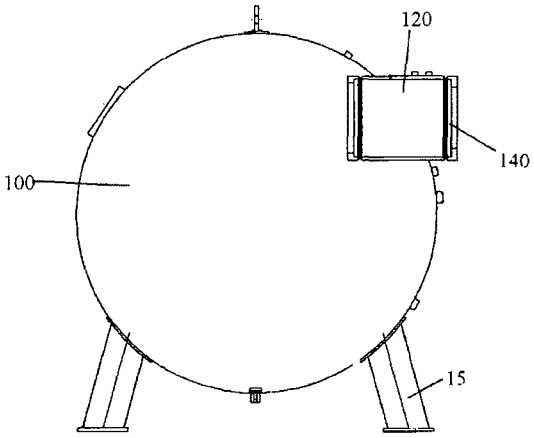
FIG. 2B illustrates an end view of the pressure vessel shown in FIG. 2A.

FIG. 2A shows a decompression or recompression pressure vessel 100 for human occupancy according to an embodiment of the present invention. In the following description, the term "pressure vessel" is used to refer to pressure vessels for human occupancy, for eg., during treatment of decompression sickness. As shown in FIG. 2A, the pressure vessel is made up of two sections, an inside treatment chamber 12 and an outer airlock chamber 13. Each chamber is closed by a respective airlock door 30 and each has its own observation port 40. The pressure vessel 100, incorporating a medical, supply or transfer lock 120, is usually made of steel and usually conforms to American Society of Mechanical Engineers (ASME)'s pressure vessel code, ASME-PVHO-1, which regulates pressure vessels built for human occupancy. As shown in FIGS. 2A and 2B, the pressure vessel 100 is supported on four legs 15. Two lifting lugs 17 are provided on top of the pressure vessel 100 for handling purposes. Generally, the pressure vessel 100 is built for an operating pressure range of about 5 bar (or 73 psi) to about 30 bar (435 psi) and is designed to withstand an internal pressure above the operating pressure according to the relevant code's recommended pressure, such as 1.5 times the operating pressure. After the pressure vessel 100 is completed with the medical/transfer lock 120 and entry/exit airlock doors 30, it is filled and tested with water under pressure (ie. hydro-tested). After installation of all the operational life support, communication and accessories, the medical lock's sealing function is tested with air under pressure.

Figure 3A:
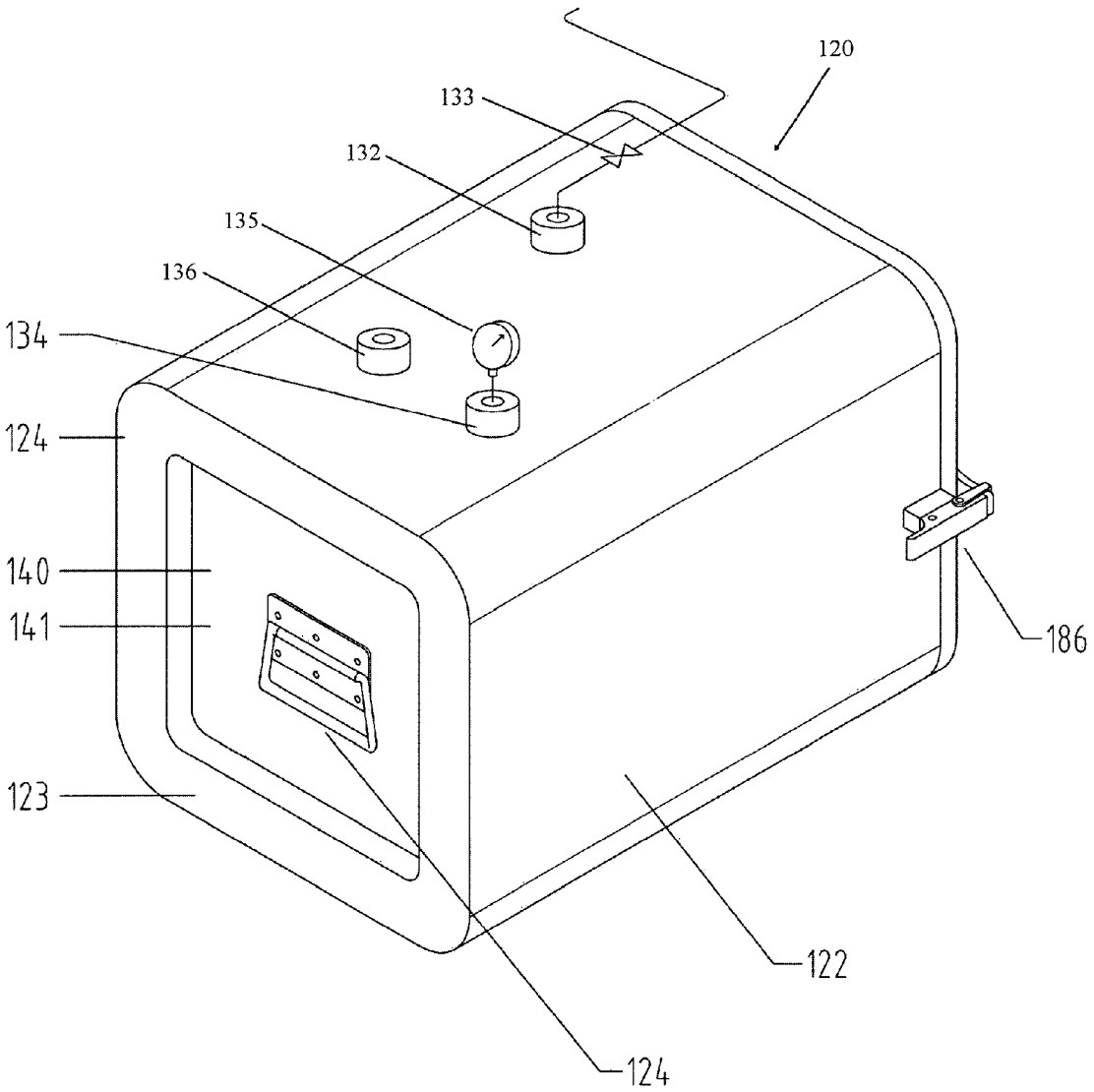
FIGS. 3A and 3B illustrate a medical lock system according to an embodiment of the present invention for use with the pressure vessel shown in FIG. 2A.
Figure 3B:
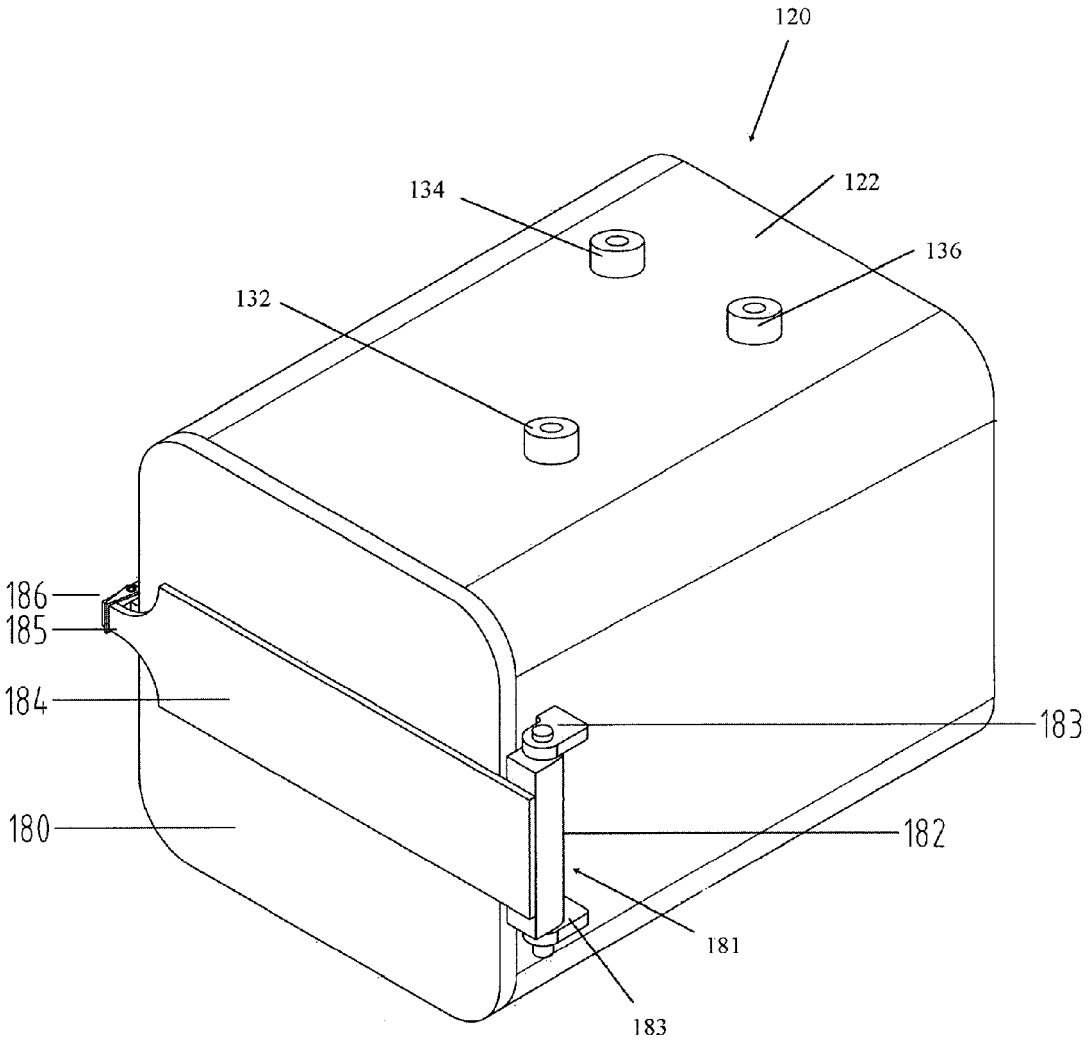
Figure 3C:
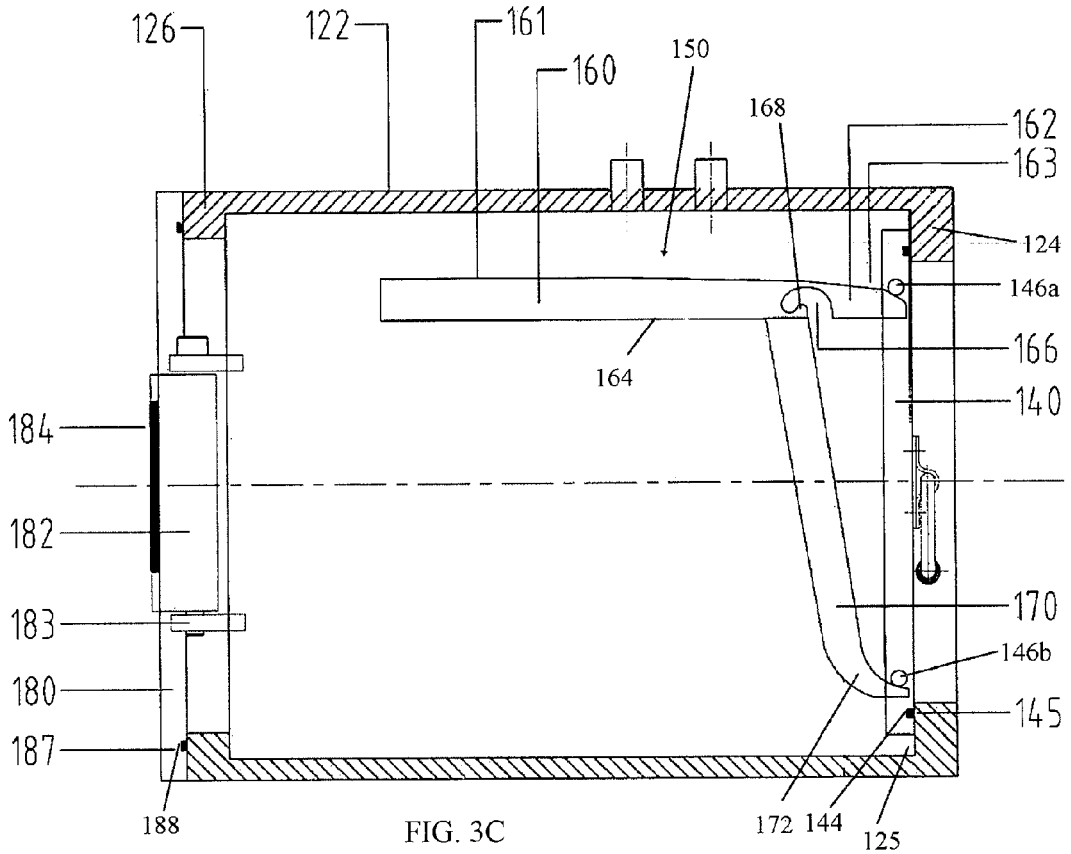
FIG. 3C shows a vertical sectional view of the medical lock system, whilst

FIG. 3A shows a perspective view of the medical or supply lock system 120 as seen from outside the pressure vessel 100 according to an embodiment of the present invention. FIG. 3B shows the perspective view of the medical/supply lock system 120 as seen from inside the pressure vessel 100. FIG. 3C shows a vertical sectional view of the medical/supply lock. As shown in FIGS. 3A and 3B, the medical/supply lock 120 is made up of a body in the form of a tube 122 of rectangular shape, an outer door 140 and an inside door 180. The body tube 122 is welded to the pressure vessel 100 and is oriented so that a side, forming the base 123 of the medical lock 120, is substantially horizontal. Whilst dimensions of the body tube 122 are not restrictive, in one embodiment, the body tube 122 has outside dimensions of about 35 cm square by 46 cm long and a thickness of about 12 mm. As will be appreciated later, the body tube 12 of these dimensions provide an entry space of about 23 cm square after taking into account dimensions of a door flange 124 and door support mechanisms 150; this entry space allows a typical food tray of about 20 cm wide for food, drink and/or medicine to be transferred to the occupant(s) inside the pressure vessel 100 via the medical lock 120 without affecting the pressure and air compositions in the pressure vessel 100 when decompression or recompression treatment is going on.

As can be seen in FIGS. 3A and 3B, on the top side of the body tube 122, there are two fittings 132,134. Fittings 132,134 allow fluid or gas communication to the inside of the body tube 122. Fitting 132 may be connected to a valve 133 for equalising the pressure inside the medical lock 120 or body tube 122 with that inside the pressure vessel 100 or with the ambient pressure. Fitting 134 may be connected to a pressure gauge 135 to monitor the pressure inside the medical lock 120 or body tube 122. A spare fitting 136 may also be provided.

As can be seen in FIG. 3C, each of the two ends of the body tube 122 is welded a door flange, an outer door flange 124 and an inner door flange 126. The opening of the outer door flange 124 is slightly smaller than the inner door flange 126 such that an outer face 141 of the outer door 140 is arranged to contact an inner face 125 of the outer door flange 124. In addition, around the edge of the outer face 141 of the outer door 140 is an endless groove 144. A seal 145 is disposed in the groove 144 to give the interface between the outer door 140 and its door flange 124 an air-tight seal. In one embodiment, the outer door 140 is made of aluminium, preferably of a marine grade; for example, the aluminium door 140 is about 30 cm square and has a thickness of about 16 mm; in another embodiment, the outer door 140 is made of steel or stainless steel. Other materials complying with ASME-PVHO standard or equivalent standard may also be used.

Figure 3D:
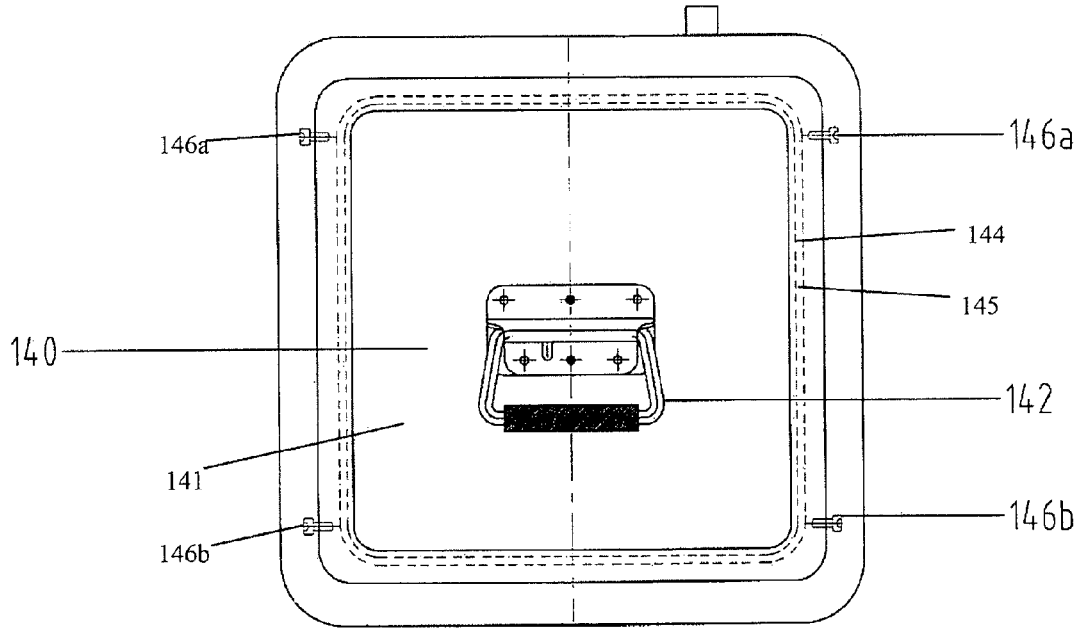
FIG. 3D shows an outer door of the medical lock system.

FIG. 3D shows an end view of the outer door 140. As shown in FIG. 3D, on the outer face 141 of the outer door 140, near its centre, there is a handle 142. On each of the two vertical side edges of the outer door 140, there are two spaced apart rollers, an upper roller 146*a* and a lower 146*b*. The outer door 140 is supported at the rollers 146*a*, 146*b* by a door support mechanism 150. The door support mechanism 150 comprises a substantially horizontal rail 160 and a slant rail 170 mounted on each of the two vertical inside walls of the body tube 122, as shown in FIG. 3C. At a front end 162 of the substantially horizontal rail 160, its upper surface 161 has a gentle curved profile 163 that slopes downward and intersects with its lower surface 164. Near the front end 162, the lower surface 164 has a curved slot 166 for receiving the lower roller 146*b*. The curved slot 166 has a heel 168 so that the lower roller 146*b* sitting in the curved slot 166 cannot be displaced without lifting the lower roller 146*b* over the heel 168. As shown in FIG. 3C, an upper end of the slant rail 170 is mounted below the substantially horizontal rail 160 such that the right hand surface, as seen in FIG. 3C, of the slant rail 170 on which the lower rollers 146*b* run on, leads into the curved slot 166. The lower end 172 of the slant rail 170 is curved towards the outer door flange 124. When the outer door 140 is being opened or closed, the upper rollers 146*a* run on the upper surface 161,163 of the substantially horizontal rail 160 while the lower rollers 146*b* run on the right hand surface of the slant rail 170. In one embodiment, the substantially horizontal and slant rails 160,170 are made of brass and they are bolted onto the vertical inside walls of the tube 122. In another embodiment, the rails 160,170 can be made of other materials, such as, aluminium (preferably of marine grade), stainless steel, engineering polymer and so on.

In another embodiment, on each of the two vertical side edges of the outer door 140, there are two spaced apart sliders or skates, an upper slider/skate 146*a* and a lower slider/skate 146*b* (instead of rollers). The sliders/skates function like the above rollers and no further description on the use of the sliders/skates 146*a*, 146*b* is thus necessary. In one embodiment, the sliders/skates 146*a*,146*b* are made of materials such as steel, stainless steel, engineering polymer and so on.

Figure 4A:
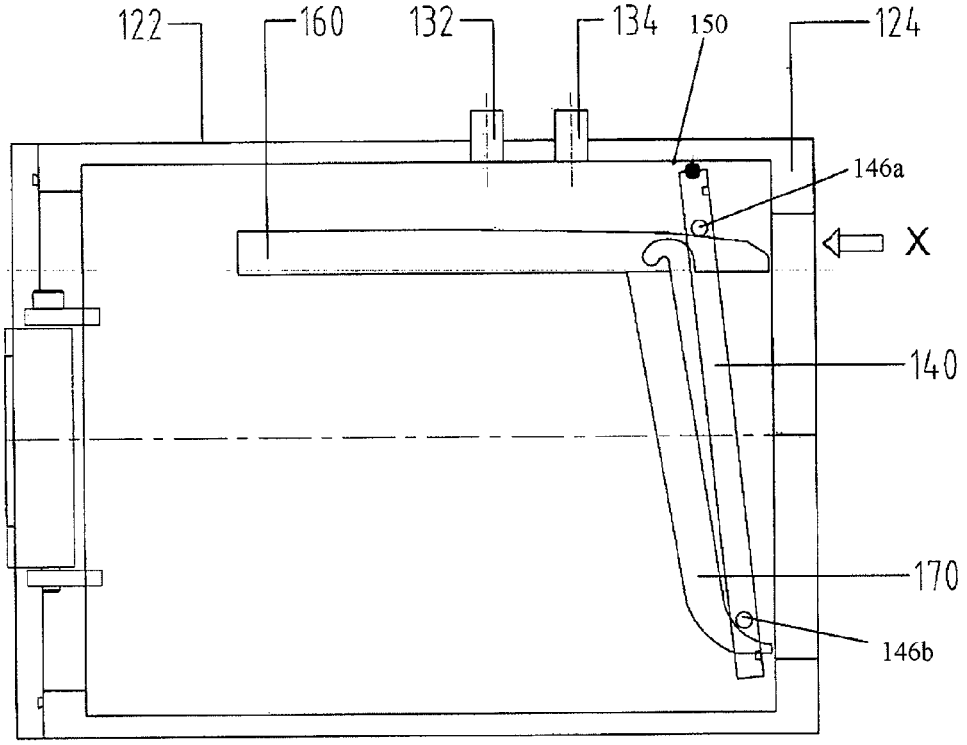
FIGS. 4A-4F illustrate the stages of opening of the medical lock's outer door shown in FIG. 3A.
Figure 4B:
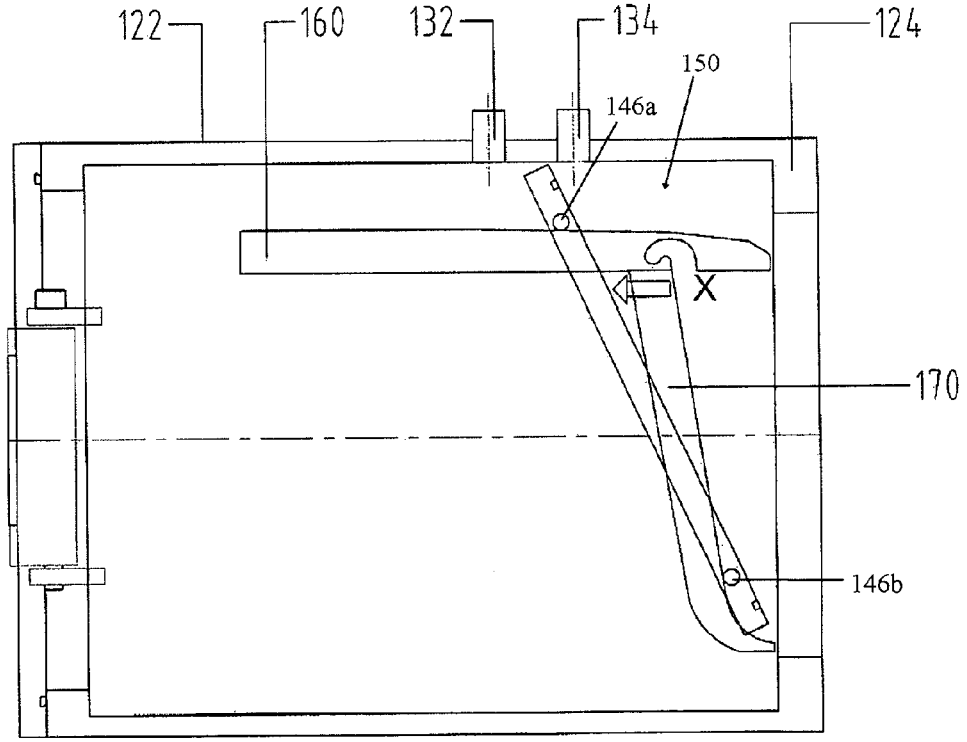
Figure 4C:
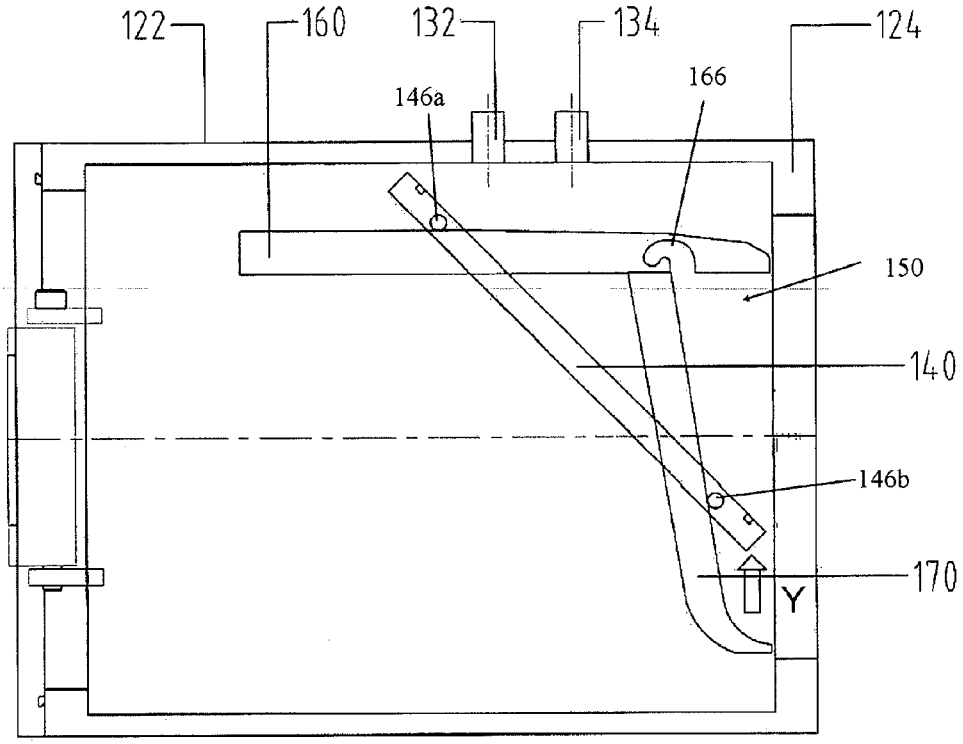
Figure 4D:
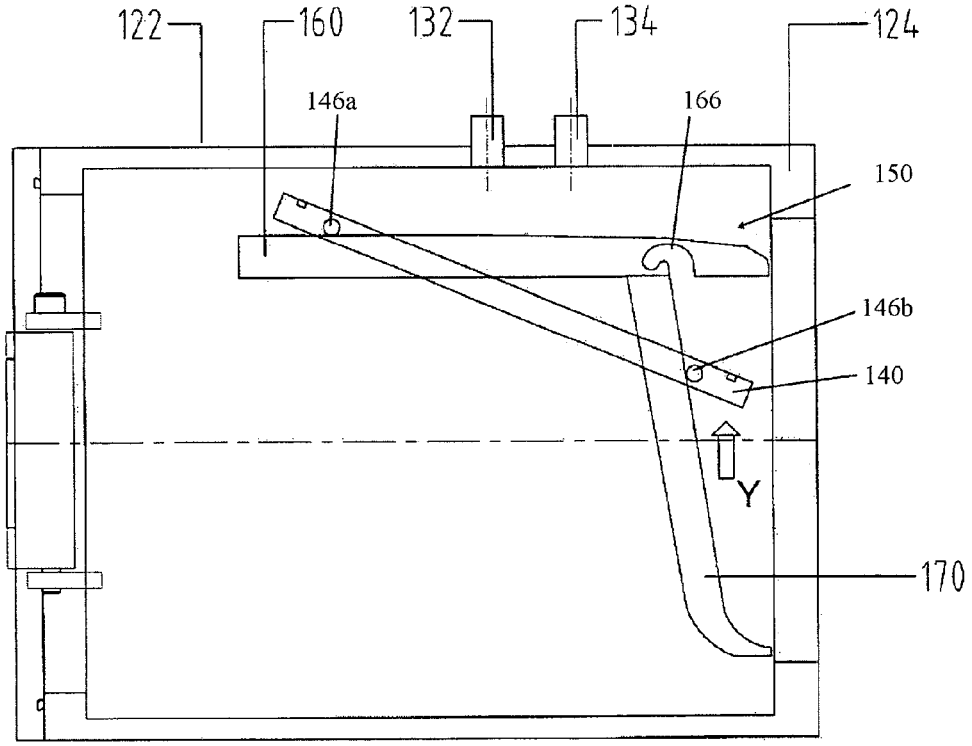
Figure 4E:
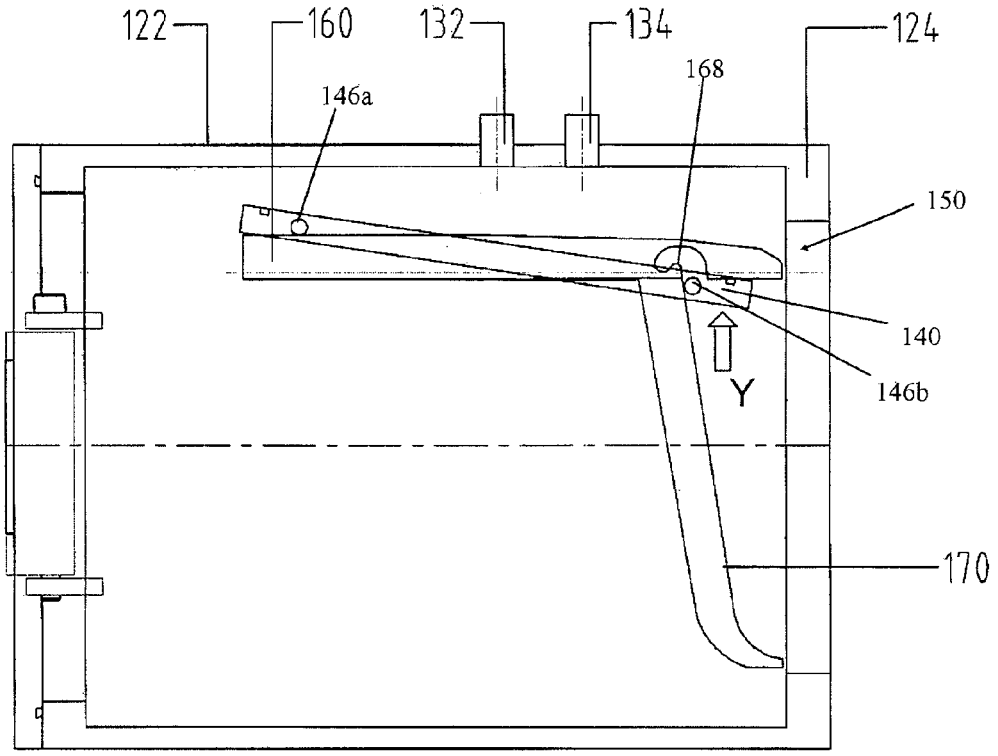
Figure 4F:
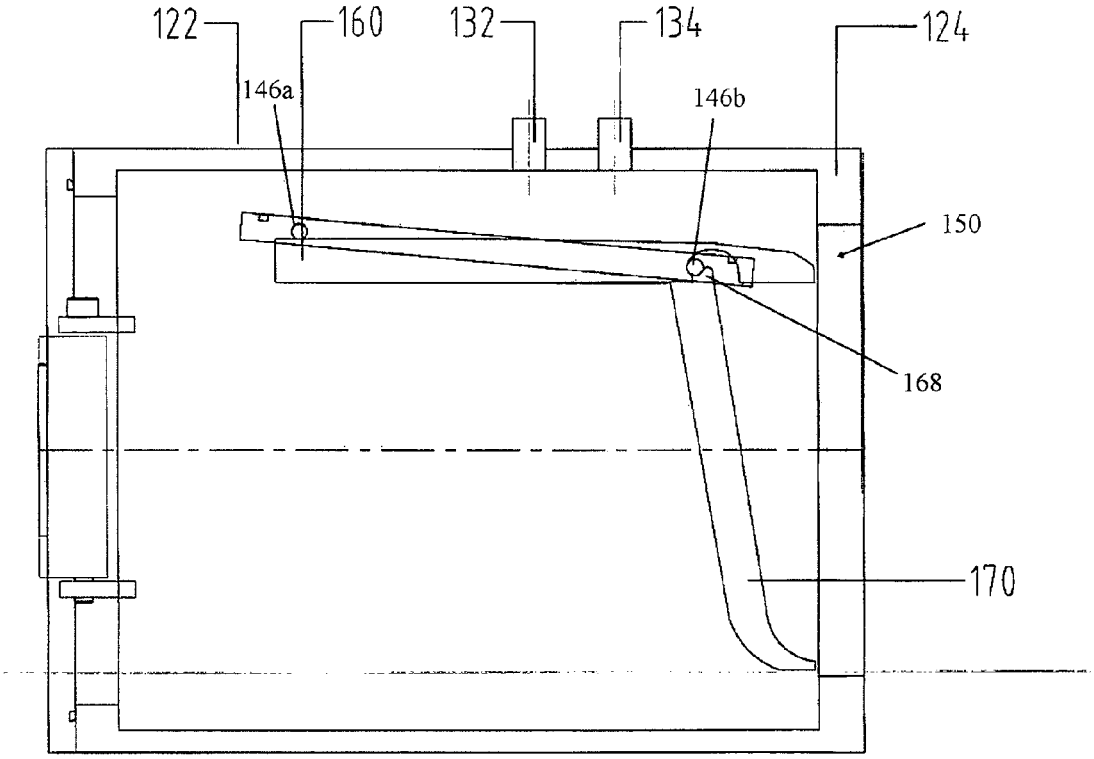

FIGS. 4A-4F show the various stages of opening of the outer door 140. In FIG. 3C, the outer door 140 is in the closed position and it is sealed against the inside surface 125 of the outer door flange 124. Sealing of the outer door 140 against the door flange 124 is aided by an outward component of the weight of the outer door 140 as the rollers 146*a*,146*b* slide on the curved surfaces or ends of the substantially horizontal and slant rails 160,170; in this position, the weight of the outer door 140 and the curved surfaces or ends of the rails 160,170 assist the outer door 140 to be self-locking. To open the outer door 140, a push in the direction of arrow X (as shown in FIG. 4A) is exerted on an upper part of the outer door 140; this causes the rollers 146*a*,146*b* to move up on the respective rails 160,170 and thus moves the outer door 140 away from the outer door flange 124. As the push in the direction X continues, the outer door 140 is opened further by tilting inwards, as shown in FIG. 4B. As the outer door 140 is opened further, the space between the lower edge of the outer door 140 and the outer door flange 124 grows bigger; this space allows one's fingers to lift the lower edge of the outer door 140 as one continues opening it, as shown in FIGS. 4C and 4D. When the lower rollers 146*b* reach the upper end of the slant rails 170, the lower rollers 146*b* are pushed into the curved slots 166, up over the heel 168 and sit inside the curved slots 166 (as shown in FIGS. 4E and 4F).

To close the outer door 140, an upward force is exerted on the outer door 140 so that the lower rollers 146*b* are lifted over the heels 168 and out of the respective curved slots 166. By holding the lower edge of the outer door 140 and lowering it, the rollers 146*a*, 146*b* slide on the respective rails 160,170 until the outer door 140 contacts the door flange 124. A pull on the handle 142 compresses the seal 145 between the outer door 140 and door flange 124, and the outer door 140 then stays in position because a component of the weight of the outer door exerts it against the door flange 124. In use, when the air pressure inside the medical lock 120 or body tube 122 is brought up to the treatment pressure inside the pressure vessel 100, the air pressure creates an additional force on the outer door 140 to further compress the seal 145. In this manner, the present invention provides a medical lock 120 with a self-locking and self-sealing outer door 140, which is also easy to operate and maintain.

FIG. 3B shows the inside door 180 according to another embodiment of the present invention. As shown in FIG. 3B, on the outside vertical wall of the body tube 122, near its inside end, is mounted a hinge 181. The hinge 181 has a body 182 that is pivoted between two lugs 183. The hinge body 182 has a bar 184 that extends across to the vertical wall of the body tube opposite the hinge 181. The bar 184 supports the inside door 180 and the free end of the bar 184 has a smaller section 185 that engages with a latch 186 to lock the inside door 180 to the body tube 122. In one embodiment, the inside door 180 is shaped and dimensioned to fit with the body tube 122. Referring to FIG. 3C, the inside end of the body tube 122 has the inner door flange 126. The face of the inside door 180 for contact with the inner door flange 126 has an endless groove 187, which receives a door seal 188. The door seal 188 ensures air-tightness in the medical lock 120 or body tube when the inside door 180 is closed against the inner door flange 126. In one embodiment, the inner door 180 is made of aluminium, steel or stainless steel. In another embodiment, the door seals 145, 188 are O rings; in yet another embodiment, the door seals 145,188 are lip seals.

Figure 5:
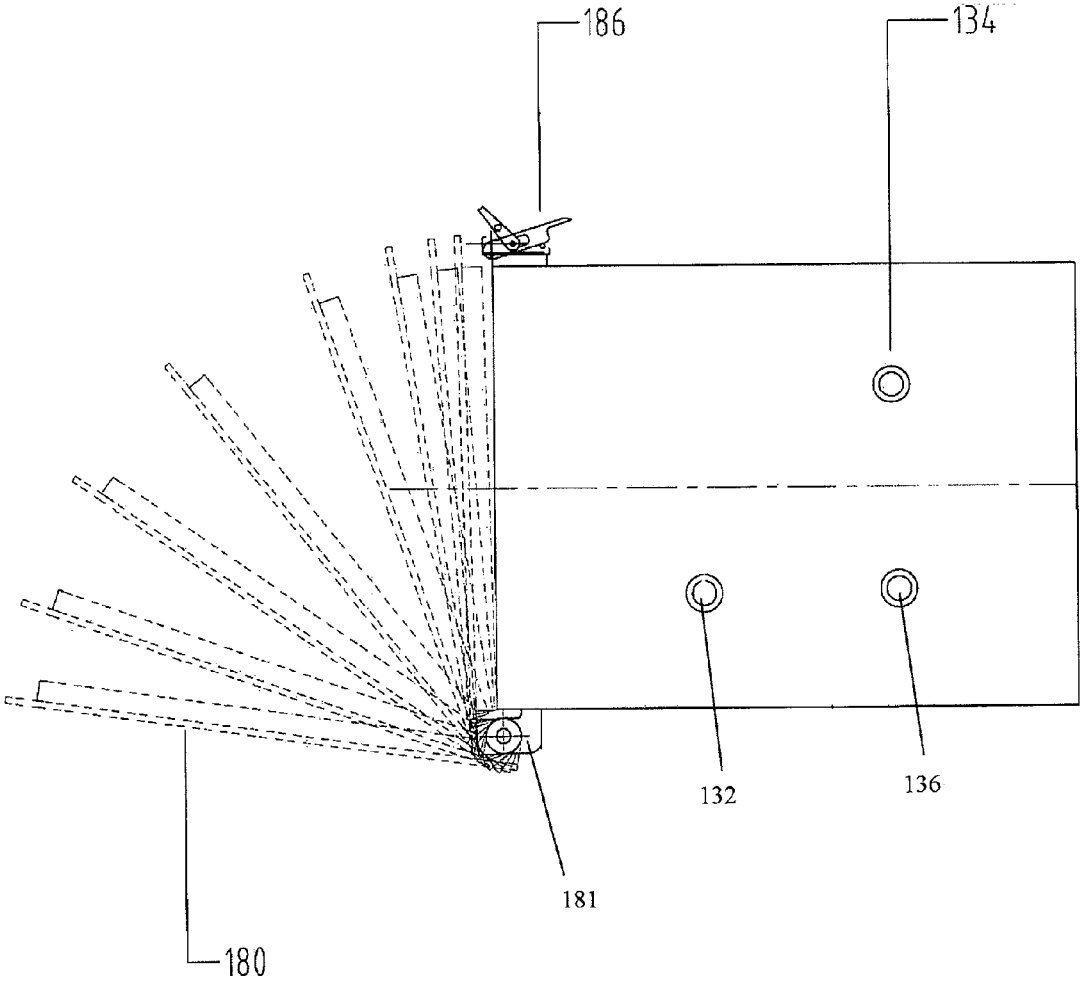
FIG. 5 illustrates the opening of the medical lock's inner door shown in FIG. 3B.

FIG. 5 shows a part of the medical lock 120 in plan view and the stages of opening of the inside door 180. Preferably, the latch 186 is a tension type and it provides an initial compression on the seal 188 when the inside door 180 is locked. In use, when the air pressure inside the pressure vessel 100 is brought up to the treatment pressure, the pressure differential between the inside of the pressure vessel 100 and the medical lock 120 acting on the entire face of the inside door 180 creates a force to prevent the inside door 180 from being opened. When food, drink and/or medicine is to be transferred from the medical lock 120 into the pressure vessel 100 during treatment, the pressure inside the medical lock 120 is equalised with that in the vessel 100, for example, by controlling the valve 133 connected to the fitting 132. Once there is no pressure differential across the inside door 180, the occupant or attendant inside the pressure vessel 100 can loosen the latch 186 and disengage the bar 185 with the latch 186 for the inside door 180 to open. After retrieving the food, drink and/or medicine, the inside door 180 is closed again and the latch 186 engaged with the bar 185 to prevent inadvertent loss of pressure and/or gas inside the pressure vessel 100.

Figure 6A:
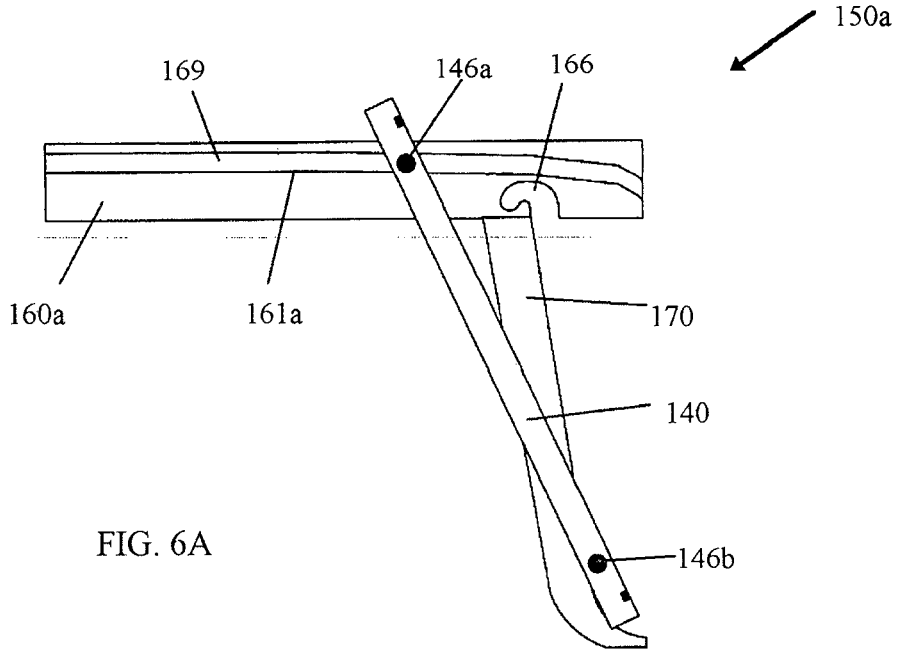
FIGS. 6A-6C illustrate door support mechanisms according to yet other embodiments of the present invention.

FIG. 6A shows a door support mechanism 150*a* according to another embodiment of the present invention. The door mechanism 150*a* is functionally similar to that of the above mechanism 150 except that a surface 161*a* of the substantially horizontal rail 160*a* on which the upper rollers/sliders/skates 146*a* move on is formed in a groove 169, as shown in FIG. 6A.

Figure 6B:
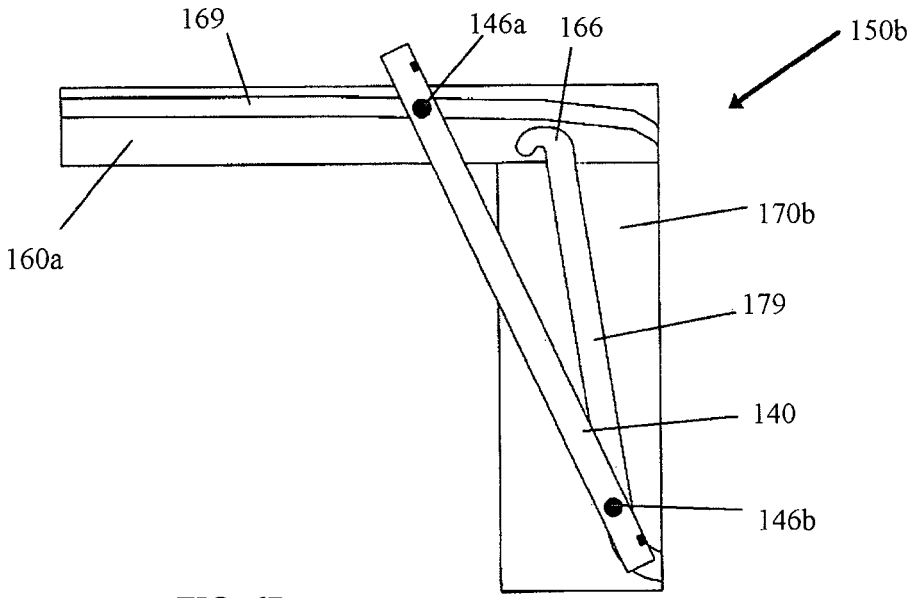

FIG. 6B shows a door support mechanism 150*b* according to another embodiment of the present invention. The door support mechanism 150*b* is functionally similar to mechanisms 150 and 150*a*. As shown in FIG. 6B, the surface on a slant rail 170*b* on which the lower rollers/sliders/skates 146*b* move on is formed in a groove 179. In a variation, the rollers/sliders 146*a*, 146*b* may be configured by providing a rotatable rod or rods 146*c* straddling between the grooves 169, 179 on opposite rails 160*a*, 170*b*; in other words, the rotatable rod(s) supported in the grooves 169, 179 are rotatable like rollers; this variation is preferably implemented when materials of the rails 160*a*, 170*b* are dissimilar with material of the rod(s) 146*c*.

Figure 6C:
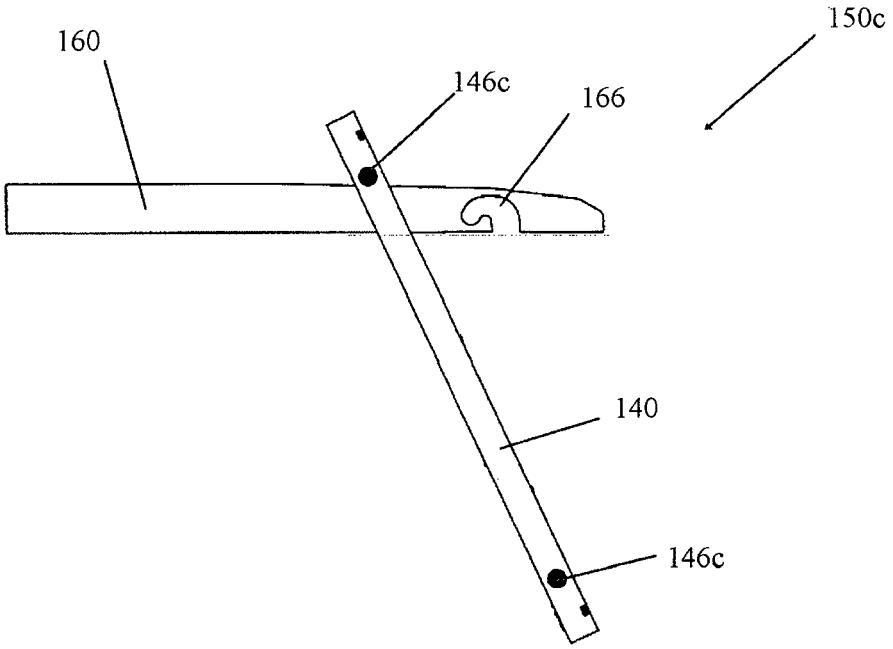

While specific embodiments have been described and illustrated, it is understood that many changes, modifications, variations and combinations thereof could be made to the present invention without departing from the scope of the present invention. For example, in the above description, a pressure vessel capable of withstanding high pressures as typically used for treating divers or miners is illustrated. The medical, supply or transfer lock 120 of the present invention can also be used with a low pressure hyperbaric vessel (also known as medical chamber) that is used for treating patients with other medical conditions. In the figures, only one medical, supply or transfer lock 120 is shown. It is possible that the pressure vessel 100 be equipped with two or more medical, supply or transfer locks 120. Further, the outer and inside doors of the medical lock 120 of the present invention need not be quadrilateral, rectangular or square in shape; the outer and inside doors 140,180 may be round. In addition, the outer door 140 is supported by an upper rotatable rod 146*c* without the slant rail, as shown in FIG. 6C, whilst the lower rod 146*c* is for locking into the groove 166 to hold the outer door 140 in its open position. The upper rotatable rod 146*c* effectively provides at least an axis for supporting the outer door 140.

The invention claimed is:

1. A medical lock for a pressure vessel for human occupancy comprising:

a body tube for penetration mounting with a shell of said pressure vessel, with an outer end of said body tube extendable outside said pressure vessel whilst its inner end is disposed inside said pressure vessel;

an outer door flange connected to said outer end of said body tube;

an outer door in sealing face relation with an inside face of said outer door flange;

a substantially horizontal rail mountable on each of two inside walls of said body tube;

a slant rail mountable below each said substantially horizontal rail and at an angle to said associated substantially horizontal rail so that the slant rails incline towards said outer door flange;

a first support axis, which extends out of each of two sides of said outer door; and a second support axis, which extends out of each of two sides of said outer door in spaced apart relation with said first support axis;

wherein extended ends of said first support axis are constrained to move on said substantially horizontal rails and extended ends of said second support axis are constrained to move on said slant rail so that when said outer door is being opened by lifting it upwardly in a substantially vertical manner, said outer door is then retracted into an upper part said body tube in a substantially horizontal orientation, or is closed in a reversed manner, such that during opening or closing, said outer door is made to go partly around and above food, water, medicine and/or supplies disposed in said body tube; and wherein, when said outer door is in the closed position, pressure inside said medical lock allows said outer door to be self-locking and self-sealing.

2. A medical lock according to claim 1, wherein an end of said substantially horizontal rail adjacent said outer door flange has a curved profile that slopes downward to generate a weight component of said outer door to assist the outer door to close.

3. A medical lock according to claim 1, wherein an end of each said slant rail adjacent said outer door flange is curved so that a weight component of said outer door is generated to assist said outer door to close.

4. A medical lock according to claim 1, wherein each extended end of said first support axis or each extended end of said second support axis comprises a roller, a slider or skate.

5. A medical lock according to claim 1, wherein said sealing face of said outer door has an endless groove and a seal is disposed therein to provide an air-tight seal between said outer door and said outer door flange.

6. A medical lock according to claim 1, wherein said outer door is square, rectangular or quadrilateral in shape.

7. A medical lock according to claim 1, wherein an outer face of said outer door comprises a handle.

8. A medical lock according to claim 1, wherein an inclined edge of each said slant rail, on which said extended ends of said second support axis are constrained to move, leads to a curved slot in a lower surface of said associated substantially horizontal rail.

9. A medical lock according to claim 8, wherein said curved slot has a heel to prevent said extended ends of said second support axis from being dislodged without applying an uplift force.

* * * * *